United States Patent [19]

Allen

[11] Patent Number: 4,635,414

[45] **Date of Patent: * Jan. 13, 1987**

[54] ADJUSTABLE DOOR JAMB LEVELER

[76] Inventor: Ernest R. Allen, 1131 Vine St., Jonesboro, Ark. 72401

[ * ] Notice: The portion of the term of this patent subsequent to Oct. 23, 2001 has been disclaimed.

[21] Appl. No.: 547,137

[22] Filed: Oct. 31, 1983

Related U.S. Application Data

[63] Continuation-in-part of Ser. No. 418,429, Sep. 15, 1982, Pat. No. 4,478,016.

[51] Int. Cl.[4] ..... E04D 15/00

[52] U.S. Cl. ..... 52/126.1; 52/741; 33/194; 33/376

[58] Field of Search ..... 52/126.1, 126.4, 741, 52/217; 33/194, 375, 376

[56] References Cited

U.S. PATENT DOCUMENTS

| | | | |
|---|---|---|---|
| 2,689,412 | 9/1954 | Young . | |
| 2,748,493 | 6/1956 | Williams . | |
| 2,855,695 | 10/1958 | Buck . | |
| 3,648,378 | 3/1972 | Thingstad et al. | 33/376 X |
| 4,478,016 | 10/1984 | Allen | 52/213 X |

OTHER PUBLICATIONS

Ezy-Set Jamb Leveler, sales brochure, The Allen Corporation.

*Primary Examiner*—Carl D. Friedman

*Attorney, Agent, or Firm*—Nies, Webner, Kurz & Bergert

[57] ABSTRACT

A device for use in positioning and securing a door jamb in a level condition. The device includes a spacer plate assembly having outer end portions which extend beneath the inner portion of the sides of the jamb during the leveling process. A pair of bolt shaped members are threadedly received in the spacer plate assembly, one at each end thereof, to provide a means of raising and lowering the ends of the spacer plate assembly. A suitable level indicating unit such as a carpenter's level is also mounted on the spacer plate. The device further includes a pair of anchor base plates which are mounted in the floor, one at each end of the spacer plate, adjacent the lip extensions. The bolt members are rotated until the level indicating unit shows the spacer plate to be in a level condition, at which time each side of the door jamb is fixed to the respective anchor base plate by anchor screws or similar means. The spacer assembly is then withdrawn, leaving the door jamb mounted in a level condition on the anchor base plates. In one embodiment, the spacer plate assembly is provided with means at each end thereof for adjusting the length of the assembly so as to fit door jambs of various widths.

15 Claims, 6 Drawing Figures

10
11
12
14
16
17
18
20
24
26
28
29
30
31
32
33
34
35
36
38
40
42

ADJUSTABLE DOOR JAMB LEVELER

BACKGROUND AND SUMMARY OF THE INVENTION

This is a continuation-in-part of application Ser. No. 418,429 filed Sept. 15, 1982 now U.S. Pat. No. 4,478,016.

The present invention relates to a device for leveling door jambs. More particularly, the present invention is concerned with a device which allows the leveling of prefabricated metal door jambs without the use of wedges so that the door jambs may be very rapidly erected and secured to the floor during construction of a building in which doors or similar frames are to be installed.

Previous devices for aligning door jambs have included those described in the following U.S. Pat. Nos. 2,689,412 to Young; 2,748,493 to Williams; and 2,855,695 to Buck. In the Buck patent there is described a vertical frame which is utilized within the door jamb to hold the jamb in alignment while wedges are used. In the Williams patent there is described the use of horizontal leveling means for a device which is intended to provide a frame within the door jamb. The Young patent discloses the use of hand screws to raise and lower a leveling device but there is no disclosure of the use of any type of jamb anchor feature for maintaining the door jamb in position.

By the present invention there is provided a device for use in leveling door jambs in a rapid and efficient manner without the use of wedges, shims or other aids of this type. In one embodiment, the door jamb leveling device of the present invention includes a spacer plate assembly which, during use, is intended to extend along the floor between the inner surfaces of the sides of an upright door jamb. The spacer plate is provided on each end thereof with a lip extension of relatively thin construction which extends beneath the inner portion of each side of the jamb. A pair of leveler swivels are threadedly received in the spacer plate, one at each end thereof, to be controlled by hand screws for the purpose of raising and lowering the entire assembly. The upper surface of the spacer plate assembly is so constructed as to support a standard carpenter's level. The present leveling device also includes a pair of jamb anchors in the form of base plate members which are disposed with one anchor positioned within each of the side portions of the door jamb in position flush with the floor, said anchor plates having upstanding portions which conform to the interior configuration of the hollow side portions of the door jamb.

In order to level the door jamb, the spacer plate assembly is positioned on the floor so as to extend across the width of the proposed doorway. The jamb anchor plates are anchored to the floor adjacent each end of the spacer assembly and the door jamb is positioned so as to rest on the lip extensions of the spacer plate. The hand screws on the spacer plate assembly are turned, thus raising or lowering the spacer plate, until the sight glass in the carpenter's level shows the jamb to be in a level condition. Suitable securing means such as screws are then employed to secure the door jamb to the jamb anchor plates thus retaining the door jamb at the desired height. The spacer plate assembly may then be removed from the doorway and the jamb will remain mounted in a level condition on the anchor plates.

In an alternative embodiment, the length of the spacer plate assembly is adjustable so as to be readily adapted to fit door jambs of various sizes. Upon adjustment of the spacer plate assembly to fit the width of a particular door jamb, the leveling device may then be utilized to install the door jamb in a level position.

The door jamb leveling device of the present invention is particularly suitable for use with metal prefabricated door jambs and allows the leveling of such door jambs in a matter of minutes as compared with an hour or more which has been required to level door jambs by the use of previous methods using shims, wedges and the like.

DESCRIPTION OF THE PREFERRED EMBODIMENTS

Figure 1:
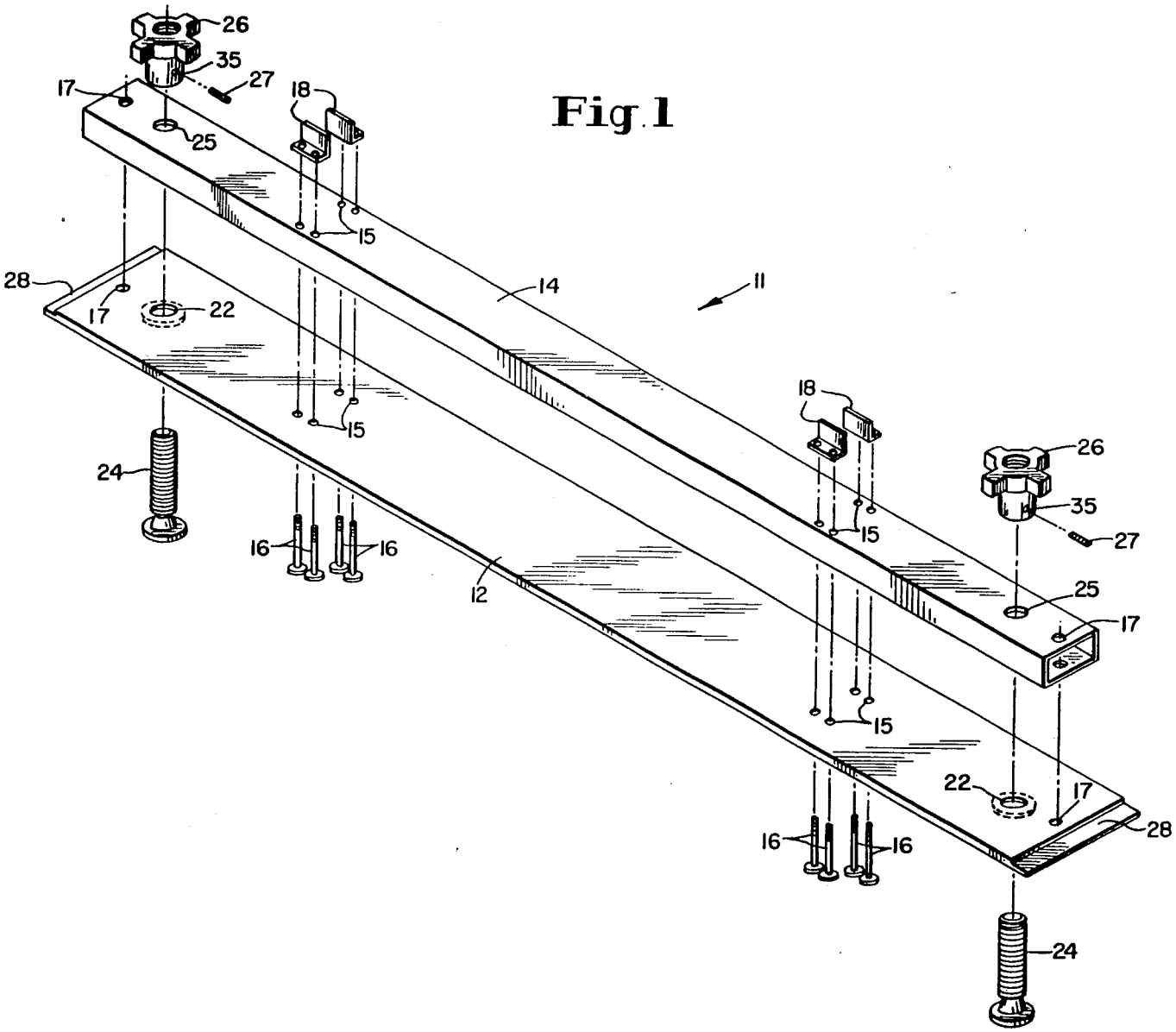
FIG. 1 is a perspective view in exploded form showing the spacer plate assembly with attached components of the leveling device of the present invention.

In the door jamb leveler device 10 of the present invention as shown in FIGS. 1 through 4, there is provided a spacer plate assembly 11 which includes planar member 12 which functions as a central spacer member in conjunction with an upper block member 14 mounted on member 12 and extending along the entire length of the main portion of member 12.

The block member 14 is mounted on the planar member 12 by suitable attachment means such as screws 16 which extend upwardly through holes 15 in planar member 12 and block 14. Additional attachment means may extend through holes 17. The upper ends of screws 16 are threadedly received in L-shaped bracket members 18 which are mounted on the upper surface of the block member 14 for the purpose of receiving a standard carpenter's level 20.

The planar member 12 is provided with a threaded aperture 22 at each end thereof for the purpose of receiving a bolt shaped, threaded swivel member 24 which extends upwardly through respective apertures 22, 25 in members 12 and 14. A hand screw 26 in the form of a knob shaped member of conventional construction is threadedly received on the upper end of each of the swivel members 24. A set screw 27 or similar means is inserted in hole 35 in the side of each hand screw 26 to maintain the hand screw 26 in a fixed position on the respective swivel member 24. In one embodiment, the swivel member 24 is formed with a swivel construction directly below the threaded portion of member 24, thus allowing the threaded portion to pivot about the base of member 24. One form of such a swivel member is known as a knob shoe.

The planar member 12 is provided with a lip extension 28 of relatively thin vertical dimension on each end of member 12. The lip extensions 28 extend beneath the inner portions 29 of the sides of the jamb 31 during the leveling procedure.

Figures 2, 3, 4:
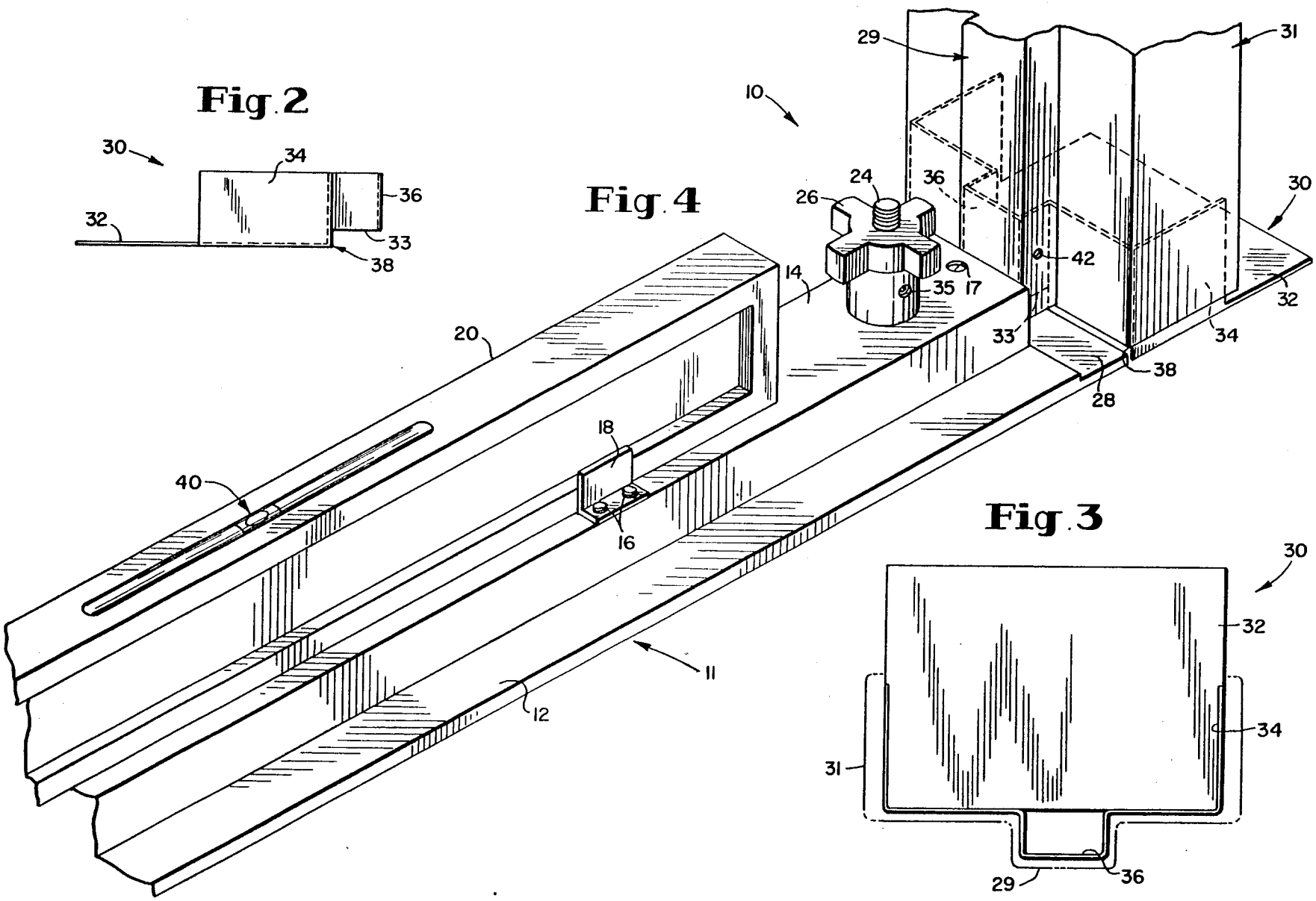
FIG. 2 is a side elevational view of a jamb anchor plate member of the present invention.
FIG. 3 is a plan view of a jamb anchor plate member of the present invention.
FIG. 4 is a perspective view showing the spacer plate assembly of the present invention in cooperation with a jamb anchor plate member for the leveling of a door jamb, and with a standard carpenter's level mounted on the upper surface of the spacer plate assembly.

The door jamb leveler device 10 of the present invention further includes a pair of anchor base plate members 30, with each anchor plate member 30 having a horizontal planar portion 32 and an upstanding vertical portion 34 in sheet form which extends upwardly from planar portion 32 and conforms to the configuration of the interior of the hollow vertical side portion of the door jamb 31. The central portion 36 of each upstanding member 34, conforming to the inner portion 29 of the side wall of the door jamb 31, has its lower edge 33 sufficiently raised above the planar portion 32 so as to avoid being engaged by the lip extension 28 on member 12 during the leveling operation. The outer end of each lip extension 28 of the planar spacing member 12 is thus contiguous in use with the respective inner end 38 of the horizontal planar portion 32 of the base plate members 30, as shown in FIG. 4.

In order to level the door jamb 31, the spacer plate assembly 11 is positioned on the floor so as to extend across the width of the proposed doorway. The base plates 30 are then positioned on the floor so as to be contiguous with the lip extensions 28 of the spacer member 12 as previously described. The outer edge of each lip extension will be aligned along the length of the inner end portion 38 of the base plate 30, thus aiding in proper alignment of the base plate 30 and the door jamb 31. The base plates 30 are anchored to the floor by the use of, for example, a conventional anchoring gun with suitable rivets or similar means. The door jamb 31 is then positioned so that the side wall portions will coincide with previously formed vertical members 34 of the base plates 30 and with inner portions 29 of the jamb 31 resting on the lip extensions 28 of the spacer member 12. The hand screws 26 at each end of spacer plate assembly 11 are then manually turned, causing the spacer member 12 to move up or down along the length of the threaded swivel members 24. Turning of the hand screws 26 continues until the sight glass 40 in the carpenter's level 20 shows the jamb 31 to be in a level condition. Anchor screws 42 are then driven through the jamb 31 into the jamb anchor base plates 30 at either end to retain the jamb 31 at the desired height. The spacer plate assembly 11 may then be removed from the doorway by sliding the lip extensions 28 out from under jamb inner portions 29 and the jamb 31 will be retained in a level position by the anchor plates 30 which are permanently affixed to the door jamb 31 and to the floor.

The specific dimensions to be employed for the door jamb leveling device 10 of the present invention will depend upon the size of the door jamb 31 to be installed. In general, the length of the planar spacer member 12 should be sufficient to extend from one side wall portion of the door jamb 31 to the other, and with the lip extensions 28 on either end of the member 12 extending under center portions 29 of the jamb 31 to engage the inner surfaces 38 of the base portion 32 of anchor plates 30 along the entire length of surfaces 38. Thus the overall length of the spacer member 12, including lip extensions 28, may be of a size such as 2′ 4″, 2′ 8″, 3′ or 4′, for example, all of which are standard door jamb sizes. In one embodiment of the invention, in which the overall length of spacer member 12 is 3 feet, the width of member 12 is 4 inches, the vertical dimension of the lip extension 28 is $\frac{1}{8}$ inch and the length of extension 28 is $\frac{5}{8}$ inch. In this embodiment, the base portion 32 of jamb anchor plate 30 has an overall length of $3\frac{3}{8}$ inches and inner portion 36 thereof has a length of $\frac{5}{8}$ inches. The height of anchor plate 30 is 2 inches and the lower edge of portion 36 is located about $\frac{1}{2}$ inches above the base 32. The anchor plates 30 may be constructed of prefabricated steel or similar material. The spacer plate members 12 and 14 may be constructed of a suitable metal or other durable material.

Figure 6:
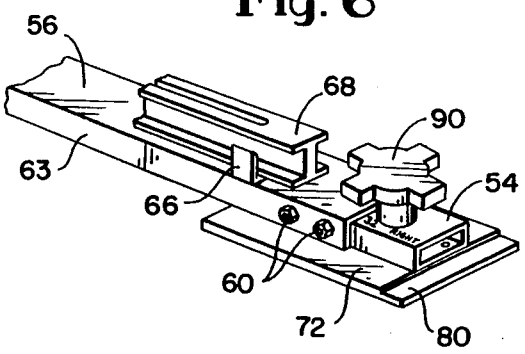
FIG. 6 is a perspective view showing a portion of the leveling device of FIG. 5 in position for installation.
Figure 5:
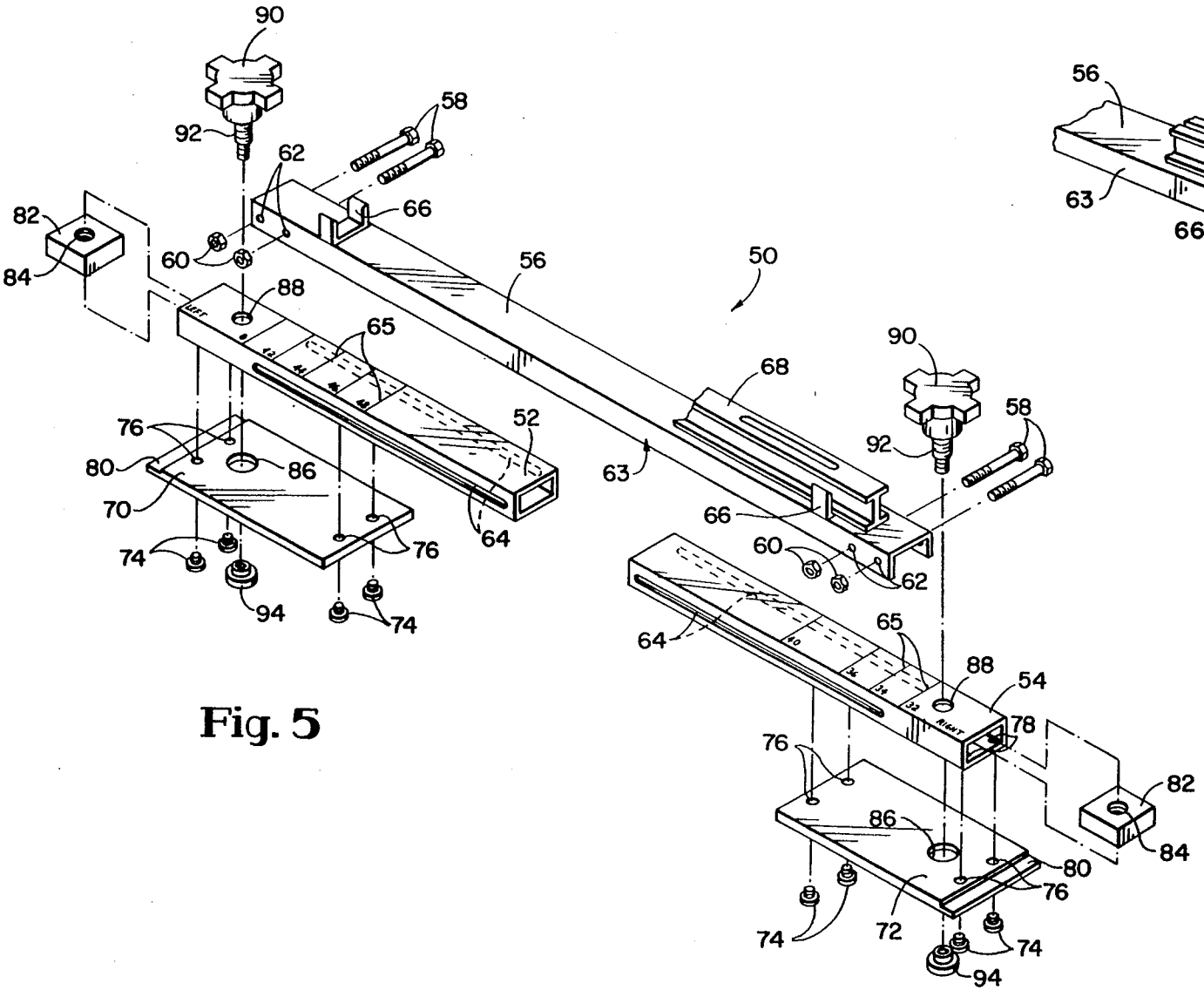
FIG. 5 is a perspective view in exploded form showing a second embodiment of the leveling device of the present invention.

In the embodiment of the invention as shown in FIGS. 5 and 6, there is provided an adjustable spacer plate assembly 50 which includes a pair of hollow, longitudinally extending spacer members 52, 54 of rectangular cross-section. A longitudinal brace member 56 having a U-shaped cross-section with downwardly extending side walls 63 is slidably mounted over the top portion of both spacer members 52, 54 in overlapping engagement by means of a series of bolts 58 with attachable nuts 60. The bolts 58 extend through respective holes 62 in the side walls 63 of the brace member 56 and through a longitudinal slot 64 in each side of both spacer members 52, 54, thus allowing each spacer member 52, 54 to slide longitudinally with respect to brace member 56, when the nuts 60 are in a loose or non-tightened condition so as to allow the length of the assembly 50 to be adjusted for door jambs of various sizes. A series of scribe marks 65 are provided at intervals such as 2 inches in the top surface of members 52, 54 to assist in positioning the assembly 50 at the desired width for a particular door jamb. The words "Right" and "Left" are also entered on members 52, 54 at the corresponding end portions to assist in operation of the device.

The cross-sectional dimensions of the brace member 56 are such as to enable it to fit closely to the top and side walls of the spacer members 52, 54. The length of the member 56 should be such as to provide the dimensions necessary for proper measurement of the width of the jamb, while also providing the structural stability necessary for proper use of the assembly 50. In one embodiment, wing nuts may be used on the bolts 58 to aid in loosening the connection between the brace member 56 and spacer members 52, 54. A pair of brackets 66 are mounted on the upper planar surface of the brace member 56, for use in receiving a standard carpenter's level 68.

A pair of flat plate members 70, 72 are affixed at opposite ends of the assembly 50, with each plate 70, 72 being secured in a horizontal position to the bottom surface of a respective spacer member 52, 54 adjacent the outer end thereof by means of bolts 74 extending through holes 76 in the plates 70, 72 and similarly positioned holes 78 in the bottom surface of members 52, 54. Each plate member 70, 72 is provided with a lip extension 80 of relatively thin vertical dimension on the outer end thereof, for the same purpose as the extensions 28 previously discussed in connection with the embodiment of FIG. 1.

Each hollow spacer member 52, 54 is provided with a block-shaped member 82 which is received within the interior of members 52, 54 adjacent the outer ends thereof in close fitting engagement with the interior walls of the members 52, 54. Each block 82 has a threaded hole 84 in the center thereof which is aligned with holes 86, 88 in the plates 70, 72 and spacer members 52, 54, respectively. A handle member 90 with lower threaded bolt portion 92 is received in each set of aligned holes, with the bolt portion 92 passing through holes 84, 86, 88 so that the handle member 90 is located in position above the respective spacer member 52, 54 for use in the operation of the assembly 50 as described hereinafter.

The lower end of each bolt 92 is secured in a foot member 94 such as a knob shoe which, in one embodiment, provides a swivel connection to allow freedom of movement between the foot member 94 and bolt 92. The hole 86 in each plate is of sufficient diameter and thickness to allow the foot member 94 to fit therein so that the plate member 70, 72 will rest firmly on the floor during use.

In operation, the assembly 50 is utilized in a manner similar to the assembly 11, with the right side of the assembly 50 positioned so that the inner portions of the jamb rest on the lip extension 80 on the right end and with a base plate located adjacent thereto. In so doing, the necessity for loosening the bolts 60 for sliding movement of the members 52, 54 relative to member 56 will depend upon the width of the particular jamb being set. Thus, if the jamb has a width of 34 inches, for example, the left side of the assembly 50 can remain locked with the left end of member 56 on the "zero" scribe mark. The bolts 60 on the right side would then be loosened and the member 54 moved to the right until the right end of member 56 is on the "34" scribe mark, indicating that a total length of 34 inches between outer tips of extensions 80 has been obtained. If a larger jamb such as one having a width of 46 inches is to be leveled, then the left side of the assembly 50 must also be loosened and moved to the proper scribe mark. The right side of the assembly 50 will also require movement to the "40" mark position prior to the nuts 60 being tightened. In one embodiment, the present assembly 50 may be adjusted so as to be useful in leveling door jambs having a width of from 32 to 48 inches.

The relationship between the ends of brace member 56 with the bolts 58 and the ends of slots 64 in spacer members 52, 54 in one embodiment is such that, in the fully closed or compact condition of the assembly 50, the ends of the brace member 56 will be positioned directly over the outermost scribe mark at the respective outer ends of members 52, 54.

Upon adjusting the length of the assembly 50 to fit the width of the particular jamb, the left side of the assembly 50 is also locked in position with portion 80 under the jamb on the left side and with the anchor base plate adjacent thereto. Turning of one or both handles 90 will then result in the bolt portion 92 thereof causing upward or downward movement of the respective side of the assembly 50 as the threads of bolt 92 interact with the threaded hole 84 of the corresponding block 82. When the sight glass in the carpenter's level 68 shows the assembly 50 and thus the jamb to be in a level condition, the jamb is then secured to the anchor base plates as previously described and the leveling assembly 50 is removed.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. An adjustable device for leveling a door jamb, comprising:

a longitudinal brace member; a pair of elongated spacer members; means for slidably mounting each spacer member on a respective end portion of said brace member; a plate member secured to each spacer member and extending longitudinally outwardly therefrom, each plate member having a lip portion of relatively thin vertical dimension at the outer end thereof; and a generally vertical bolt member threadedly received in the outer end portion of each spacer member, said bolt member extending through to the lower surface of said device so as to contact the floor when said device is positioned on the floor while leveling a door jamb.

2. The device of claim 1 wherein said brace member is of an inverted U-shaped cross section with downwardly extending side walls, said brace member overlapping each of said spacer members.

3. The device of claim 2 wherein means for receiving a level indicating device is mounted on said brace member.

4. The device of claim 2 wherein said spacer members are of hollow construction, with a block member mounted in the hollow portion of each spacer member, said block having a threaded hole which receives a respective threaded bolt member.

5. The device of claim 4, wherein said brace member is slidably mounted in relation to the spacer members by bolt means extending through horizontal slots provided in each spacer member.

6. The device of claim 5 wherein a plurality of scribe marks are provided on the surface of said spacer members for use in aligning the ends of said brace member so as to provide a device of the desired length.

7. The device of claim 6 wherein, in the fully closed or compact condition of the device, the ends of the brace member are positioned in alignment with the outermost scribe marks at the respective outer ends of the spacer members.

8. The device of claim 1 wherein each bolt member is attached at the lower end thereof to a foot portion having a swivel connection to said bolt member.

9. The device of claim 8 wherein each foot portion is received within a recess located in a respective plate member.

10. The device of claim 1 wherein knob means is provided at the upper end of each bolt member for use in rotating said bolt member.

11. A method of leveling a door jamb having a top wall member joined by two side wall members, which comprises:

(a) positioning a jamb leveler assembly having a longitudinal brace member on the surface of a floor so as to extend across the width of the proposed doorway, said brace member having a spacer member slidably mounted at each end thereof and a plate member secured to each spacer member and extending longitudinally outwardly therefrom, each plate member having a lip portion of relatively thin vertical dimension at the outer end thereof, and with a generally vertical bolt member threadedly received in the outer end portion of each spacer member, and wherein said leveler assembly has attached thereto a level indicating unit;

(b) positioning each spacer member relative to said brace member by sliding said spacer member along the brace member as necessary to achieve the desired overall length of said leveler assembly;

(c) mounting a jamb anchor base plate in the floor in contiguous relation with the lip portion at each end of each plate member, each anchor base plate having a planar base member and a vertical member having a shape which conforms to the interior configuration of a side wall of the door jamb:

(d) mounting the door jamb so that the side wall portions extend over and adjacent to the corresponding vertical members of said anchor base plates, and with the center portions of said side walls resting on the lip portions of the plate members;

(e) rotating the bolt members of said spacer members until the level indicating unit shows the leveler assembly to be in a level condition;

(f) securing each door jamb side wall to the respective anchor base plate while said leveler assembly is in a level condition; and (g) removing the leveler assembly from the doorway.

12. The method of claim 11 wherein the central portion of the vertical member of each base plate has its lower edge raised above the planar base member of said base plate so as to avoid being engaged by the lip portion of the respective plate member during the leveling operation.

13. The method of claim 11 wherein said brace member is of an inverted U-shaped cross section with downwardly extending side walls and wherein said spacer members are of hollow construction and further wherein said step of positioning each spacer member relative to the brace member is accomplished by loosening at least one nut and bolt assembly which extends through holes in the side walls of said brace member and also through a horizontal slot in the side walls of said spacer member.

14. The method of claim 13 wherein a block member is mounted in the hollow portion of each spacer member, said block having a threaded hole which receives a respective threaded bolt member and wherein each bolt member is attached at the lower end thereof to a foot portion having a swivel connection to said bolt member, each foot portion being received within a recess located in a respective plate member, and further wherein said step of rotating said bolt members is accomplished by rotating a knob located at the upper end of each bolt.

15. The method of claim 11 wherein a plurality of scribe marks are provided on said spacer members and wherein the step of positioning each spacer member relative to the brace member includes aligning the ends of said brace member with one of said scribe marks.

* * * * *